US008876228B2

(12) United States Patent
Laible et al.

(10) Patent No.: US 8,876,228 B2
(45) Date of Patent: Nov. 4, 2014

(54) DOOR FOR A HOUSEHOLD APPLIANCE

(75) Inventors: Karl-Friedrich Laible, Langenau (DE); Helmut Steichele, Lauingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1079 days.

(21) Appl. No.: 11/919,571

(22) PCT Filed: Mar. 30, 2006

(86) PCT No.: PCT/EP2006/061161

§ 371 (c)(1),
(2), (4) Date: Oct. 29, 2007

(87) PCT Pub. No.: WO2006/120072

PCT Pub. Date: Nov. 16, 2006

(65) Prior Publication Data

US 2009/0302723 A1 Dec. 10, 2009

(30) Foreign Application Priority Data

May 10, 2005 (DE) ..... 10 2005 021 534

(51) Int. Cl.

| | |
|---|---|
| ***A47B 88/00*** | (2006.01) |
| ***A47L 15/42*** | (2006.01) |
| *F25D 23/10* | (2006.01) |
| *F25D 23/02* | (2006.01) |

(52) U.S. Cl.

CPC ..... *A47L 15/4265* (2013.01); *F25D 23/10* (2013.01); *F25D 23/02* (2013.01)

USPC ..... 312/204; 312/265.6

(58) Field of Classification Search

USPC ..... 312/326–329, 204, 265.5–265.6, 348.4, 312/296; 403/326, 329; 52/287.1, 288.1, 52/718.04

See application file for complete search history.

(56) References Cited

U.S. PATENT DOCUMENTS

| | | | | |
|---|---|---|---|---|
| 3,294,461 | A * | 12/1966 | Barnard et al. | 312/204 |
| 3,501,186 | A * | 3/1970 | Trump et al. | 312/204 |
| 3,525,190 | A * | 8/1970 | Betz et al. | 52/784.15 |
| 5,735,261 | A * | 4/1998 | Kieslinger | 126/190 |
| 7,451,574 | B2 * | 11/2008 | Spek | 52/288.1 |
| 2004/0168384 | A1 * | 9/2004 | Wesolowska | 52/287.1 |
| 2004/0222725 | A1 * | 11/2004 | Park et al. | 312/405 |
| 2005/0006997 | A1 * | 1/2005 | Yoshioka | 312/405 |

FOREIGN PATENT DOCUMENTS

| | | |
|---|---|---|
| DE | 8002426 U1 | 5/1980 |
| DE | 91 13 828 U | 1/1992 |
| DE | 42 00 333 | 7/1992 |
| EP | 0 108 677 | 5/1984 |
| EP | 1245916 A2 | 10/2002 |

(Continued)

OTHER PUBLICATIONS

International Search Report PCT/EP2006/061161.

*Primary Examiner* — Hanh V Tran

(74) *Attorney, Agent, or Firm* — Nixon & Vanderhye, P.C.

(57) ABSTRACT

A door for a household appliance. The door includes a door body having an appliance-side plate and an outer-side decorative panel spaced from the appliance-side plate by a gap. A profiled cover extends at least between a portion of a side of the appliance-side plate to a portion of a side of the outer-side decorative panel such that the profiled cover closes off a side edge extent of the gap.

27 Claims, 2 Drawing Sheets

(56) References Cited

FOREIGN PATENT DOCUMENTS

Figure 1:
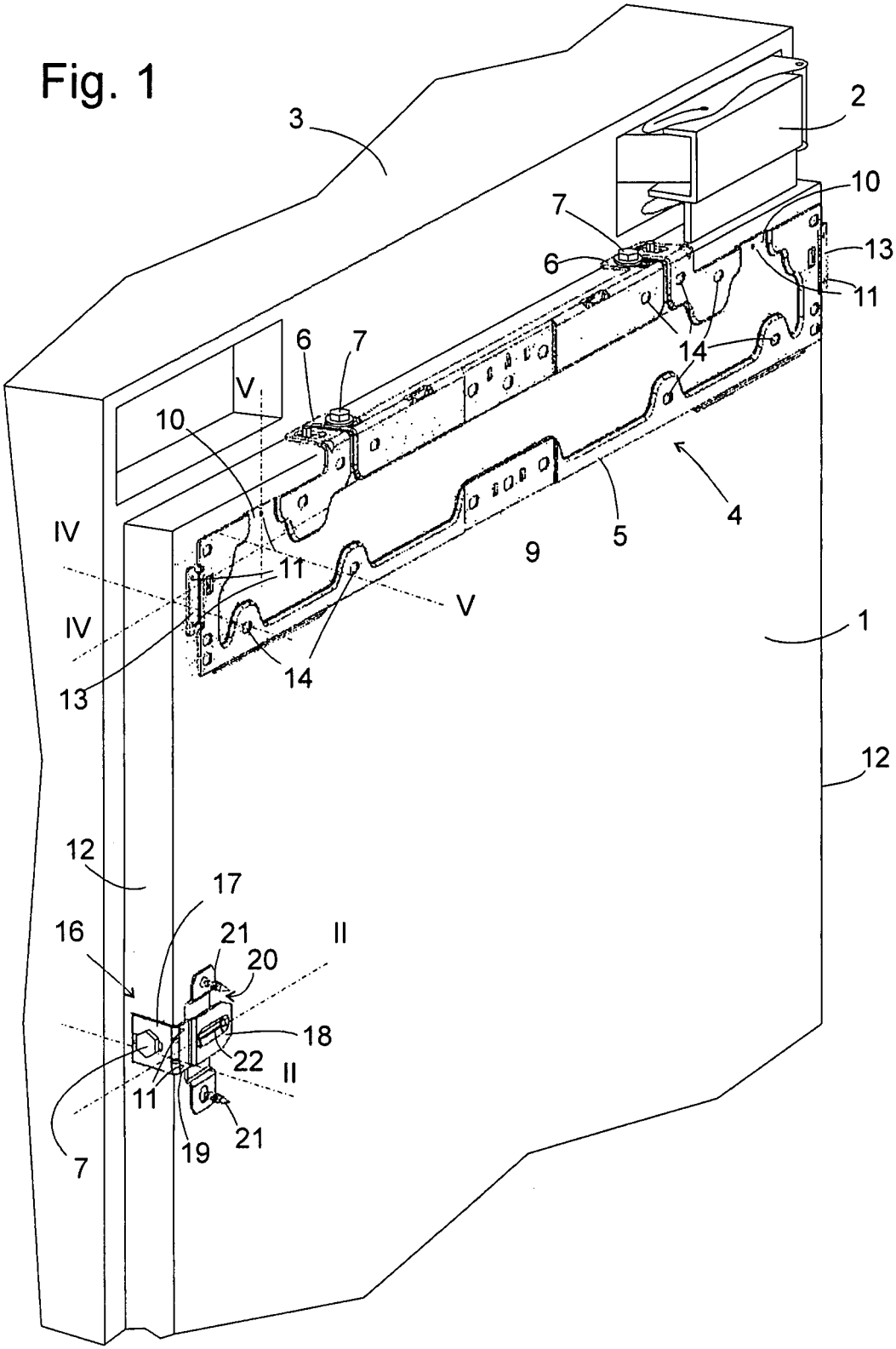

| | | |
|---|---|---|
| EP | 1 477 753 | 11/2004 |
| GB | 1155923 | 6/1969 |
| GB | 2 050 814 | 1/1981 |
| GB | 2186311 A | 8/1987 |
| GB | 2 246 195 | 1/1992 |

* cited by examiner

DOOR FOR A HOUSEHOLD APPLIANCE

This application is a U.S. National Phase of International Application No. PCT/EP2006/061161, filed Mar. 30, 2006, which designates the U.S. and claims priority to German Application No. 102005021534.3, filed May 10, 2005, the entire contents of each are hereby incorporated by reference.

The present invention relates to a door for a household appliance such as a refrigerator or freezer cabinet, a dishwasher or similar.

Household appliances which are built into kitchen furniture in a known manner or are placed adjacent to said furniture are frequently provided on their front side with a decor panel of which the design corresponds to that of the furniture doors. To achieve a precisely flush arrangement of the furniture doors and the decor panels of the doors of the household appliances, the latter are generally embodied from a number of parts, from an appliance-side plate which handles the technical functions of closing-off the inner space of the household appliance and as a rule is pre-mounted on the appliance ex-works, and the decor panel which is mounted later when the household appliance is set up at its intended location with the aid of adjustable adapter pieces on the device-side plate, and essentially has an aesthetic function. The necessity of being able to adjust the position of the decor panel in relation to the appliance-side plate means that there is mostly a gap present between the two, which is aesthetically unsatisfactory, in which dirt can collect or even into which small objects can fall.

The object of the present invention is to create a door for a household appliance with a decor panel and the appliance-side plate with which the disadvantages of the gap are avoided.

The object is achieved by a door of the type specified above in which the gap is closed around the edges by a profiled cover.

Such a profiled cover can be formed at low cost by extruding it from plastic.

To attach it the profiled cover preferably has a spring which locks into the gap. This and where necessary further attachment means interacting with it are, when the profiled cover is fitted, hidden inside the gap and thus do not detract from the outside appearance of the door.

Since an option for adjusting the panels in relation to each other should be provided not only in the plane of the panels, but also perpendicular to this, the surfaces of the panels delimiting the gap are not sufficient to clamp the springs of the profiled cover. Thus a rigid element is preferably arranged in the gap which delimits a groove clamping the spring.

To make it more difficult for the spring to disengage from the groove the rigid element is preferably provided with claws protruding into the groove.

The rigid element can especially be an attachment bracket, the first of two arms of which is held on a rear side of the decor panel and the second attached to a flank of the appliance-side plate in order to join the two panels to each other.

These two arms can be connected by an intermediate section held at a distance from the decor panel, which together with the decor panel delimits said groove.

An especially simple assembly of the door is made possible if the first attachment bracket is inserted into the gap between the decor plate and a strap attached to the decor plate.

Alternatively a tab can be bent round from an edge of the first arm which, together with the decor panel, delimits the groove.

Preferably the profiled cover not only extends over the gap but also over the second arm of the attachment bracket, so that this is also invisible when the profiled cover is fitted.

Figure 2:
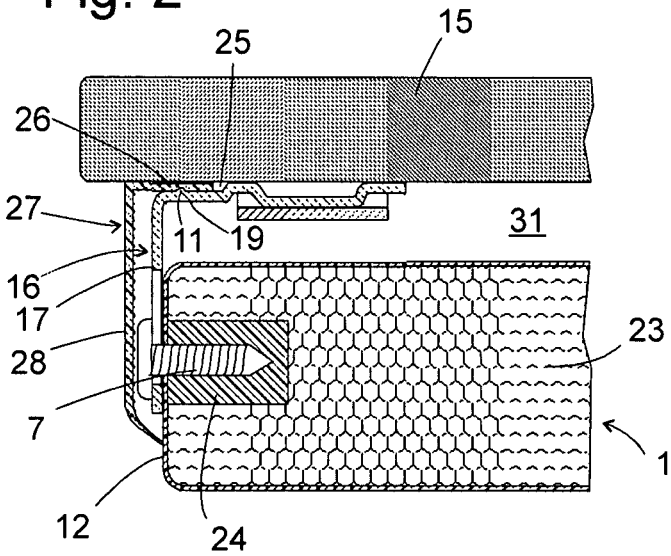
Figure 3:
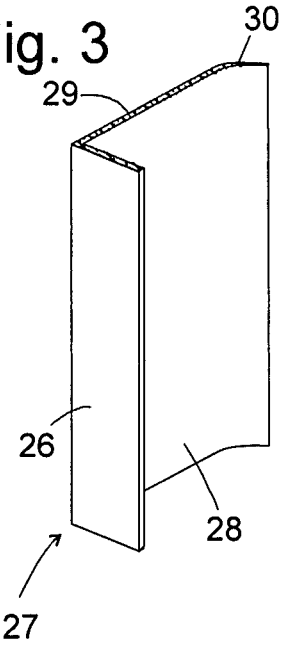
Figure 4:
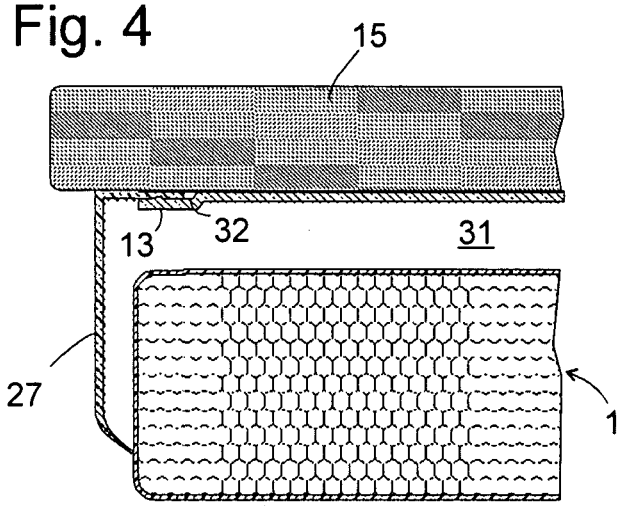
Figure 6:
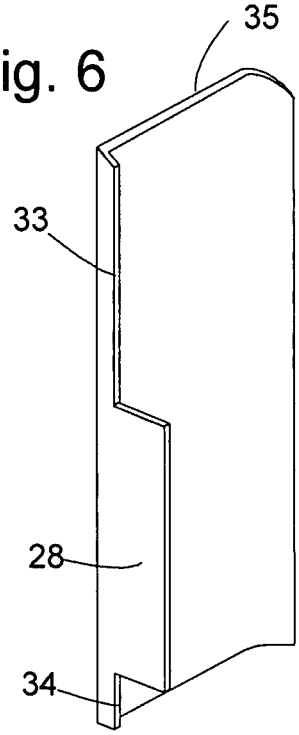
Figure 5:
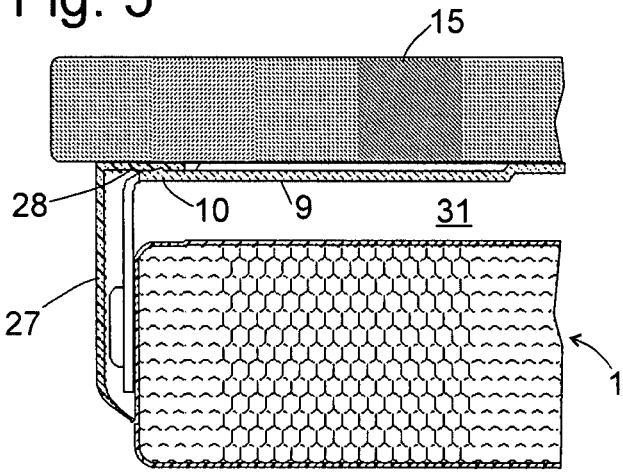

Further features and advantages of the invention emerge from the description of exemplary embodiments given below which refer to the enclosed figures. The figures show:

FIG. 1 a perspective view of a refrigerator in which the decor panel has been left off to enable the appliance-side plate of the door and the attachment means accommodated on this for adjustable attachment of the decor panel to the appliance-side plate to be shown;

FIG. 2 a horizontal part section through the inventive door in the plane defined by two lines II-II in FIG. 1;

FIG. 3 a perspective view of a part of the profiled cover;

FIG. 4 a partial section through the inventive door in the horizontal plane defined by lines IV, IV in FIG. 1;

FIG. 5 a partial section through the inventive door in the vertical plane defined by the lines V, V in FIG. 1; and FIG. 6 a piece of a profiled cover provided for fitting to the top edge of the door.

FIG. 1 shows a perspective view of the upper front area of a household refrigerator, on which the inventive door is used. Visible in the diagram are the appliance-side door plate 1 which is connected via a multi-joint hinge 2 to a carcass 3 of the refrigerator. The appliance-side door plate 1 is realized in a conventional way as a hollow body filled with a foamed polymer material. Two pairs of blind threaded holes are located in the upper edge of the door panel 1. An adjustment rail 4 has a base plate 5 extending essentially over the entire width of the appliance-side door plate 1 and two tabs 6 bent at a right angle away from the base plate. Punched into the tabs 6 are two on the holes aligned to the blind thread holes in each case. In one blind thread hole of each pair is located a special screw, of which the head is a plate, which is hidden in the figure under the tab 6 and is larger than the hole, so that the tab is supported on it and a pin protruding axially from the plate, which passes through the hole to allow play and makes it possible to turn the special screw below the tab 6 thus to adjust the height of the adjustment rail or of the decor panel attached to it. In the other blind threaded hole is a screw 7, which holds the tab 6 pressed against the plate and thus immobilizes the adjustment rail 4 on the appliance side door plate 1.

The base plate 5 is stiffened by a flat impressed rib 9 from which outriggers extend into the tab 6. At two points 10 the rib reaches up to the upper edge of the base plate 5; here a claw 11 is impressed into the rib in each case, the function of which will be explained later.

On the side edges of the base plate 5, adjacent to the side flanks 12 of the appliance-side door plate 1, are two tabs 13 bent out at right angles from the plane of the base plate 5 towards the door plate 1; they are also provided with impressed claws 11.

A plurality of holes 14 of the base plate 5 is provided, in order to attach a decor panel 15 with the aid of screws inserted through the holes (see FIGS. 2 and 4) resting on the base plate. When this has been done the locations 10 or the tabs 13 together with the opposite decor panel 15 form an insertion groove open through to the flank of the appliance-side door plate 1 into which the claws 11 protrude.

On the side flanks 12 of the appliance-side door plate 1 a number of mounting brackets 16 formed like the adjustment rail from one strong metal sheet are attached with the aid of a screw 7 which engages through a slot in a first arm 17 of the angle bracket 16 into a blind threaded hole on the flank 12. A second arm 18 of the angle bracket 16 is able to be defined by moving the slot on the screw 7 at an adjustable distance from the appliance-side door plate 1. Between the two arms 17, 18 an intermediate section 19 is formed on the mounting bracket 16 offset in parallel in relation to the second arm 18 from which once again two claws 11 protrude.

A bracket 20, also formed from metal, shown in the figure behind the second arm 18 is not permanently connected to the mounting bracket 16 but is provided to be attached to the decor panel 15 with the aid of two screws 21, in order in this way to form a slit between a center section of the arm 20 and the decor panel 14 in which the second arm 18 can be inserted from a sideways direction.

A slot 22 impressed into the second arm 18 facilitates establishment of a friction fit between the second arm 18 and the slit on introduction of the arm into this.

FIG. 2 shows a part section through the inventive door, now with the decor panel 15 at the height of the mounting bracket 16. It can be seen that the more rigid anchoring because of the blind hole thread for the screw 7 in the appliance-side door plate is formed by a massive plastic body 24 let into the expanded polymer material 23 and attached to the outer skin of the door plate 1.

Into an insertion groove 25 delimited on one side by the intermediate section 19 and on the other side by the decor panel 15 is inserted a spring 26 of a plastic profile strip 27 and is held with the aid of the claws 11 protruding into the insertion groove 25. FIG. 3 shows a section of the profile strip 27 in a perspective view. It includes a bar 28 connecting at right angles to the spring 26 with a straight line section 29 of uniform thickness and an edge section of 30 bent inwards running outwards to a point.

The width of the bar 28 is slightly larger than that of the first arm 17 of the mounting bracket 16 so that the profile strip completely hides both the mounting bracket 16 and the screw 7 as well as the gap 31 held open between the appliance-side door plate 1 and the decor panel 15. As a result of the curvature of the edge section 30 the profile strip 27 engages over the head of the screw 7 and on that side of the screw 7 close to the side of the door plate 1 facing the carcass, touches its flank 12.

On the horizontal section shown in FIG. 4 along and the plane defined in FIG. 1 by the lines IV, IV it can be seen that the profile strip 27 in the vicinity of its upper end is held in the same way in an insertion groove 32 delimited on one side by the tab 13 of the adjustment rail and on the other side by the decor panel 15, as is shown in FIG. 2.

FIG. 5 shows a part section through the door along the plane designated by the line V-V in FIG. 1. Here too an insertion groove is present between the locations 10 of the rib 9 and the decor panel 14 which grips the bar 28 of the profile strip 27. Since the positions 10 however only have a limited width the bar 28 must also be cut away at the side to enable it to be inserted into the groove. FIG. 6 shows a perspective view of an end section of such a profile strip 27 with a bar 28 cut away at the sides. To the side of the section to be inserted at point 10 in areas 33, 34, the bar is not completely cut away but only reduced in its width in order not to unnecessarily reduce the bending strength of the profile strip 27. At the upper end 35 of the profile strip in the bar a 45° miter is cut to allow a seamless connection to the profile of strip extending along at the side flanks 12.

As described above for the upper and side flanks of the door plate 1, a profile strip can of course also be clipped onto its lower flank. This is however generally not necessary since this flank is not generally visible when the device is used and there is also no danger of objects penetrating into the gap 31 here.

The invention claimed is:

1. A door for a household appliance, the door comprising:

a.) a door body having an appliance-side plate;

b.) an outer-side decorative panel, the outer-side decorative panel being spaced from the appliance-side plate by a gap such that the appliance-side plate is further toward the rear portion of the door than both the outer-side decorative panel and the gap with the gap intermediate the outer-side decorative panel and the appliance-side plate;

c.) a profiled cover, the profiled cover extending at least between a portion of a side of the appliance-side plate to a portion of a side of the outer-side decorative panel such that the profiled cover closes off a side edge extent of the gap delimited between the side portion of the appliance-side plate and the side portion of the outer-side decorative panel, wherein the profiled cover includes a spring penetrating into the gap inward of an outer periphery of the outer-side decorative panel and inward of an outer periphery of the appliance-side plate; and d.) a rigid element extending from the appliance-side plate across the gap toward the outer-side decorative panel and having a portion at a spacing from the outer-side decorative panel such that a groove is delimited between the outer-side decorative panel and the portion of the rigid element with the groove receiving therein the spring of the profiled cover.

2. The door as claimed in claim 1, wherein the rigid element includes claws protruding into the groove for engaging the spring of the profiled cover.

3. The door as claimed in claim 1, wherein the rigid element is an angle bracket having two arms with one of the arms being held on a rear side of the outer-side decorative panel and the other of the arms being attached to a flank of the appliance-side plate.

4. The door as claimed in claim 3, wherein the two arms of the rigid element are connected via an intermediate section spaced from the outer-side decorative panel and the intermediate section together with the outer-side decorative panel delimits the groove.

5. The door as claimed in claim 3, wherein the one of the arms of the rigid element is inserted into a bracket gap formed between the outer-side decorative panel and a bracket attached to the outer-side decorative panel.

6. The door as claimed in claim 3 and further comprising a tab bent outwardly at a right angle from an edge of the one of the arms of the rigid element and the tab and the outer-side decorative panel delimit the groove.

7. The door as claimed in claim 3, wherein the profiled cover extends over the other of the arms of the rigid element.

8. The door as claimed in claim 1, wherein the profiled cover is formed from an extrusion.

9. The door as claimed in claim 8, wherein the extrusion is substantially L-shaped.

10. The door as claimed in claim 1, wherein the gap is adjustable.

11. A door for a cabinet having an interior and an exterior front side, the door comprising:

a.) a door body having an interior-side plate;

b.) an exterior front-side panel, the exterior front-side panel being spaced from the interior-side plate by a gap such that the interior-side plate is further toward the rear portion of the door than both the exterior front-side panel and the gap with the gap intermediate the exterior front-side panel and the interior-side plate, wherein the gap is adjustable;

c.) a profiled cover including a tab extending into the gap, the profiled cover extending at least between a portion of a side of the interior-side plate to a portion of a side of the exterior front-side panel such that the profiled cover closes off a side edge extent of the gap delimited between the side portion of the interior-side plate and the side portion of the exterior front-side panel, wherein the tab extends into the gap inward of an outer periphery of the exterior front-side panel and inward of an outer periphery of the of the interior-side plate; and d.) a rigid element extending from the interior-side plate across the gap toward the exterior front-side panel and having a portion at a spacing from the exterior front-side panel such that a groove is delimited between the exterior front-side panel and the portion of the rigid element with the groove receiving therein the tab of the profiled cover.

12. The door of claim 11, where the tab secures the profiled cover in place by a friction fit between the front-side panel and the interior-side plate.

13. The door of claim 11, where one of the front-side panel and the interior-side plate includes a bump, located to fit a corresponding detent in the profiled cover tab, for securing the profiled cover tab in place between the front-side panel and the interior-side plate.

14. The door of claim 11, wherein the door includes a hinge.

15. The door as claimed in claim 11, wherein the profiled cover is formed from an extrusion.

16. The door as claimed in claim 15, wherein the extrusion is substantially L-shaped.

17. The door of claim 11, wherein the profiled cover has a distal end that contacts a lateral side face of the exterior front-side panel.

18. The door of claim 11, wherein a screw head is accommodated between the profiled cover and a lateral face of the exterior front-side panel.

19. A door for a household appliance, the door comprising:

a.) a door body having an appliance-side plate;

b.) an outer-side decorative panel, the outer-side decorative panel being spaced from the appliance-side plate by a gap such that the appliance-side plate is further toward the rear portion of the door than both the outer-side decorative panel and the gap with the gap intermediate the outer-side decorative panel and the appliance-side plate; and c.) a profiled cover, the profiled cover extending at least between a portion of a side of the appliance-side plate to a portion of a side of the outer-side decorative panel such that the profiled cover closes off a side edge extent of the gap delimited between the side portion of the appliance-side plate and the side portion of the outer-side decorative panel, wherein the profiled cover includes a spring penetrating into the gap, d.) a rigid element extending from the appliance-side plate across the gap toward the outer-side decorative panel and having a portion at a spacing from the outer-side decorative panel such that a groove is delimited between the outer-side decorative panel and the portion of the rigid element with the groove receiving therein the spring of the profiled cover, wherein the rigid element is an angle bracket having two arms with one of the arms being held on a rear side of the outer-side decorative panel and the other of the arms being attached to a flank of the appliance-side plate, wherein the one of the arms of the rigid element is inserted into a bracket gap formed between the outer-side decorative panel and a bracket attached to the outer-side decorative panel.

20. A household appliance comprising:

a carcass; and a door attached to the carcass, the door comprising:

a.) a door body having an appliance-side plate;

b.) an outer-side decorative panel, the outer-side decorative panel being spaced from the appliance-side plate by a gap such that the appliance-side plate is further toward the rear portion of the door than both the outer-side decorative panel and the gap with the gap intermediate the outer-side decorative panel and the appliance-side plate;

c.) a profiled cover, the profiled cover extending at least between a portion of a side of the appliance-side plate to a portion of a side of the outer-side decorative panel such that the profiled cover closes off a side edge extent of the gap delimited between the side portion of the appliance-side plate and the side portion of the outer-side decorative panel, wherein the profiled cover includes a spring penetrating into the gap inward of an outer periphery of the outer-side decorative panel and inward of an outer periphery of the appliance-side plate; and d.) a rigid element extending from the appliance-side plate across the gap toward the outer-side decorative panel and having a portion at a spacing from the outer-side decorative panel such that a groove is delimited between the outer-side decorative panel and the portion of the rigid element with the groove receiving therein the spring of the profiled cover.

21. The household appliance as claimed in claim 20, wherein the rigid element includes claws protruding into the groove for engaging the spring of the profiled cover.

22. The household appliance as claimed in claim 20, wherein the rigid element is an angle bracket having two arms with one of the arms being held on a rear side of the outer-side decorative panel and the other of the arms being attached to a flank of the appliance-side plate.

23. The household appliance as claimed in claim 22, wherein the two arms of the rigid element are connected via an intermediate section spaced from the outer-side decorative panel and the intermediate section together with the outer-side decorative panel delimits the groove.

24. The household appliance as claimed in claim 22, wherein the one of the arms of the rigid element is inserted into a bracket gap formed between the outer-side decorative panel and a bracket attached to the outer-side decorative panel.

25. The household appliance as claimed in claim 22 and further comprising a tab bent outwardly at a right angle from an edge of the one of the arms of the rigid element and the tab and the outer-side decorative panel delimit the groove.

26. The household appliance as claimed in claim 22, wherein the profiled cover extends over the other of the arms of the rigid element.

27. The household appliance as claimed in claim 20, wherein the gap is adjustable.

* * * * *